United States Patent [19]

Wilfong

[11] Patent Number: 4,854,206

[45] Date of Patent: Aug. 8, 1989

[54] ADJUSTABLE TOOL SUPPORTING DEVICE

[76] Inventor: Donald G. Wilfong, 1017 S. Stoner, Payson, Ariz. 85541

[21] Appl. No.: 151,709

[22] Filed: Feb. 3, 1988

[51] Int. Cl.[4] ..... B27B 17/00; B27B 27/08

[52] U.S. Cl. ..... 83/745; 83/574; 83/581; 83/798

[58] Field of Search ..... 83/788, 798, 797, 796, 83/794, 820, 871, 655, 745, 744, 743, 574, 463, 581; 30/166 A, 372; 269/1, 2, 166, 156, 147, 167, 169, 165

[56] References Cited

U.S. PATENT DOCUMENTS

| | | | |
|---|---|---|---|
| 24,194 | 5/1859 | Clackson | 269/147 |
| 1,738,822 | 12/1929 | Odin | 269/167 |
| 2,317,195 | 4/1943 | Husted | 269/146 |
| 2,617,452 | 11/1952 | Dowling, Sr. | 83/745 |
| 2,735,455 | 2/1956 | Forsberg | 83/745 |
| 3,124,176 | 3/1964 | Vogini | 83/745 |
| 4,179,965 | 12/1979 | Johnson | 83/745 |
| 4,283,980 | 8/1981 | Jackson | 83/798 |
| 4,353,399 | 10/1982 | Harris | 83/574 |
| 4,611,521 | 9/1986 | McCardle | 83/796 |
| 4,685,369 | 8/1987 | Beamer | 83/581 |
| 4,726,274 | 2/1988 | Pitoni et al. | 83/745 |

*Primary Examiner*—Frank T. Yost
*Assistant Examiner*—Rinaldi Rada
*Attorney, Agent, or Firm*—Richard R. Mybeck

[57] ABSTRACT

An adjustable tool supporting device for use in log and timber construction having a U-shaped frame member; a microadjustment assembly mounted to the frame member and coactive therewith to secure a timber or log therebetween; and a chain saw mounting assembly attachable to said frame member for mounting a chain saw for cutting the timber or log secured thereby and locating the saw blade for straight and angular cuts through said timer or log.

10 Claims, 2 Drawing Sheets

ADJUSTABLE TOOL SUPPORTING DEVICE

INTRODUCTION

This invention relates generally to a novel jig and more particularly to a device for use with a chain saw to control the cut produced thereby. The device enables the operator to accurately cut or shape logs, beams, and other timber types.

BACKGROUND OF THE INVENTION

Early settlers constructed permanent housing using logs cut from nearby wooded areas by notching and stacking the logs to form walls. Roofs were formed using log framing and sod covering. The chinks between the stacked logs were filled with indigenous clay mortar or sod.

Today, the construction of log homes relies on the use of close fitting timbers which have been cut and contoured to assure a chink-free wall, thus assuring an energy efficient structure having good insulating qualities due to the wood mass of the logs and the use of longer logs which do not require so many log junctures. This type of construction is utilized when the surrounding landscape requires the "woodsy" appearance of the house or cabin with the further benefit of protection against temperature extremes.

The prior art has attempted to provide various means to assist in the efficient construction of rough hewn structures in order to enable such structures to be erected on a competitive basis.

For example, Foster (U.S. Pat. No. 2,463,860) teaches a mount for portable chain saws having an elongated pointed drive arm which is driven into the log and supports a socket clamped thereto. A lateral support bar extends from the clamp socket and presents a number of annular grooves to guide the saw.

Hayden et al (U.S. Pat. No. 3,225,799) discloses a lumber sawing attachment for a portable chain saw assembly specifically directed toward cutting reclining logs lengthwise for conversion into elongated planks in remote locations.

Edmunson (U.S. Pat. No. 3,845,556) teach a cut control attachment for chain saws having a ripping dimension attachment together with angular adjustments in three planes. The attachment includes a sole plate attached to a chain saw guide bar, a ripping fence slideably and adjustably received by or attached to the sole plate for adjusting and setting a ripping width and an angle-adjustable guide bar yoke bracket with protractor on the sole plate for adjusting the cutting angle of the chain saw in one plane and an adjustable bracket bolt for adjusting the chain saw in a plane 90° removed from the yoke bracket adjustment.

Jackson (U.S. Pat. No. 4,127,046) teaches a combination portable and stationary bench-mounted chain saw apparatus adapted to establish predetermined cut angles. The apparatus comprises a portable chain saw which includes a motor secured to one side of a flat mounting plate, a saw blade guide projecting from the motor through a slot in the mounting plate in a plane normal to the plane of the mounting plate. The saw blade extends around the guide plate and is protected by a guard means pivotally attached to the mounting plate. A cradle frame detachably secures the mounting plate in a table sawing position when the chain saw is to be so used. A pivotal cradle frame pedestal and a pivotal turntable is incorporated into the assembly.

Marshall (U.S. Pat. No. 4,208,937) teaches an apparatus for accurately cutting logs and large timbers at selected angles with a chain saw having a base framework from which a plurality of vertical rods extend. The bar of the chain saw is secured to guides which slide on the rods. The saw and the base frame-work are pivotally secured to a support table so that the saw blade can be positioned in a variety of angles relative to the object to be cut. Once a given angle is selected, the device is locked for repetitious use.

As indicated by the prior art, a number of devices have been proposed to notch and dimension timbers or logs. However, many of these prior art devices have been unsatisfactory because they are either of a fragile nature and/or require delicate and time-consuming adjustment. As the cutting operation is particularly important, portability to position the guide over long logs with great accuracy, which in turn allows the construction of tight and rigid corners or seams, is particularly important with regard to finished quality and economical construction costs. Of equal importance is the necessity to create a sawing jig that is structurally rigid and able to withstand the rigors of sawing and constant movement from log to log or timber to timber.

BRIEF SUMMARY OF THE INVENTION

The present invention comprises a novel device of a structurally rugged design for supporting and aligning tools to accurately and rapidly shape and notch logs for constructing log cabins and other things therefrom. More particularly, the device hereof comprises a U-shaped portable frame which is readily disposed upon and adjustable over long logs or timbers as necessary by the activation of a screw-activated vise-like assembly operatively interposed between cross-beam and the upper arc of the U. The device includes a mounting base for a chain saw that is rigidly secured to prevent misalignment caused by chain vibration or frame movement. Replication of jig settings is easily accomplished by loosening of one grip plate prior to movement to a new cutting site. Adjustments are provided to readily locate the saw blade in preselected locations along the $-x$, 'y, and $-z$ axis of the log.

The principal object of the present invention is to provide an improved portable device for supporting and aligning tools for accurately and rapidly shaping and notching logs and timbers for the construction of log cabins and the like.

These and still further objects of the present invention as shall hereinafter appear are fulfilled in a remarkably unexpected fashion as shall be readily discerned from the following description of an exemplary embodiment thereof, especially when read in conjunction with the accompanying drawing in which like parts bear like numerals throughout the several views.

DESCRIPTION OF THE PREFERRED EMBODIMENT

The present invention relates to a novel device used as a support and retention jig for tools employed in shaping logs and other timbers used for the construction of commercial buildings and housing units. Further, the device provides a sturdy saw base that enables quick and economical timber conversion.

Figure 1:
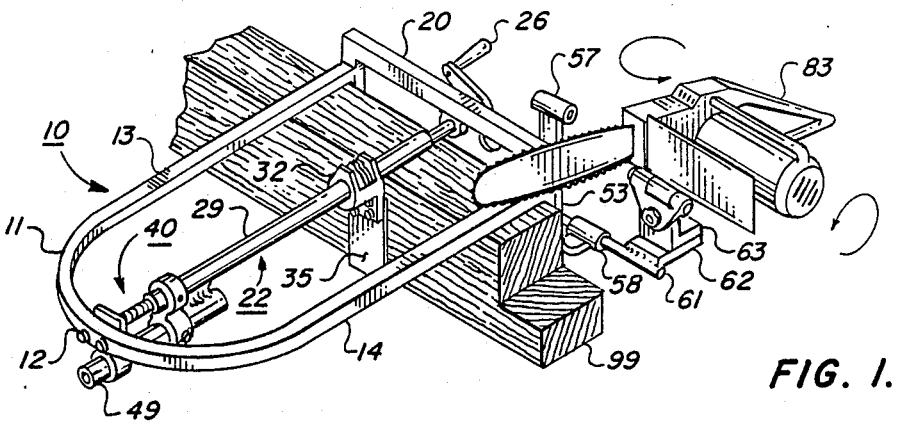
FIG. 1 is an isometric showing of a device embodying the present invention having a chain saw supported thereupon in operative relationship to a preselected timber.
Figure 2:
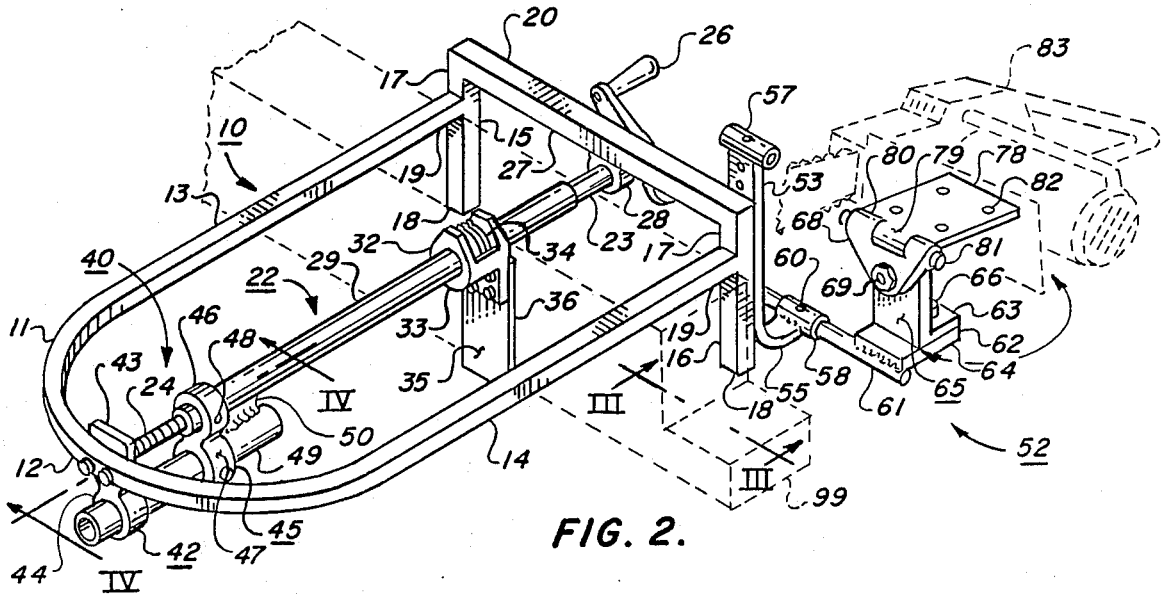
FIG. 2 is an isometric showing of a device embodying the present invention.

Referring to the drawing and particularly FIGS. 1 and 2 thereof, a device embodying the present invention is identified by the general reference 10.

Each device 10 comprises a U-shaped frame 11 having an arc portion 12 from which a first arm portion 13 and a second arm portion 14 extend in spaced generally parallel relationship to each other from the respective ends of arc portion 12 to complete the U-shaped frame 11.

An upstanding foot portion 15 is mounted to and extends transversely of arm portion 13 and a like foot portion 16 is mounted to and extends transversely of arm portion 14. Each foot portion, for example, portion 15 comprises an upper portion 17 and a lower portion 18 respectively extending from the junction with corresponding arm portion 13. The lower portion of each foot portion 15, 16 presents a timber engaging surface 19 facing arc portion 12, the function of which will be hereinafter described in detail.

The uppermost ends of foot portions 15, 16 are joined at their respective ends by cross beam 20 which completes the basic frame structure of device 10.

A micro-adjustment assembly 22 is mounted between the midpoint of cross beam 20 and the apex of arc portion 12 and comprises an elongated shaft member 23 having a threaded portion 24 at one end thereof which sets in a threaded pilot bore 25 defined at the mid point of arc portion 12. Threaded portion 24 will rotate in pilot bore 25 in response to the clockwise or counterclockwise rotation of shaft 23 in response to the rotation of crank 26 by the operator thereof. Shaft 23 is suitably mounted to the lower surface 27 of cross beam 20 by a suitable U-shaped bracket 28 which maintains the axial alignment of shaft 23 with bore 25 while permitting rotation of shaft 23 therewithin.

An elongated tubular member 29 is disposed in circumscription about shaft 23 and extends at least about 90% the length of shaft 23 between a first bracket 28 and threaded portion 24 for a purpose to be hereinafter described in detail.

A conventional pipe clamp 32 comprising a housing 33 having a plurality of spring biased rings 34 disposed therewithin for binding the clamp 32 in a fixed location relative to tubular member 29 which passes therethrough and movable in response to a manual force applied to the rings 34 to force them from their natural torqued position into a circumscribing position whereby the inside diameter of the rings, which is slightly larger than the outside diameter of the pipe about which they are circumscribed, permits ready movement of claim 32 relative to tubular member 29. A longitudinal plate member 35 is secured to clamp housing 33 and depends therefrom to present a timber engaging surface 36 facing crank 26 and coacting with surfaces 19 to define a tri-parte vise-like arrangement therewith as shall hereinafter appear in greater detail.

A controller-assembly 40 comprising a first bracket member 42 suitably secured to frame 11 and having a body portion 43 and an annular lower portion 44 depending from body portion 43; a second bracket member 45 having an annular upper portion 46 and an annular lower portion 47, upper portion 46 being threadedly disposed about the threaded end 24 of shaft member 23 for reciprocal movement therealong in response to the rotation of shaft 23 by crank 26. A pipe member 49 extends through lower annular portion 44 of bracket member 42 to and through annular portion 47 of bracket member 45 to which it is secured by a suitable set screw (not shown) or weld 50. For a purpose which will hereafter become evident, bracket 45 is movable relative to bracket 42 in response to the rotation of shaft 23 creating coaction between threaded portion 24 and annular portion 46 of bracket 45.

Figure 3:
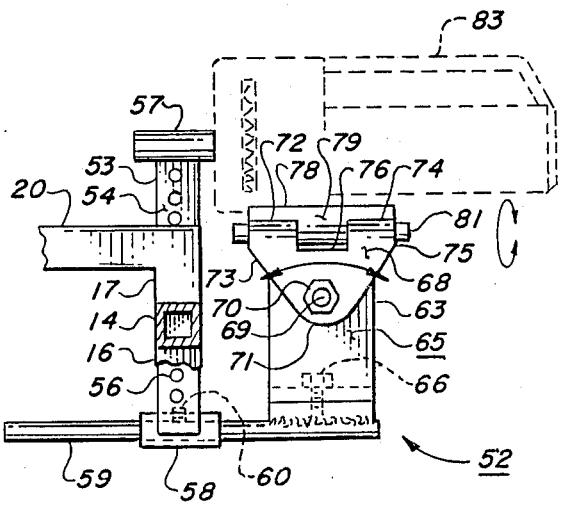
FIG. 3 is a cross-section, partially broken away, taken along line III—III of FIG. 2.
Figure 4:
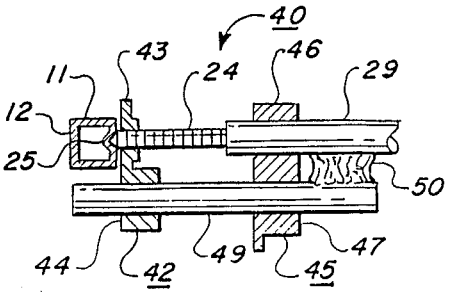
FIG. 4 is a cross-section on line IV—IV of FIG. 2.
Figure 5:
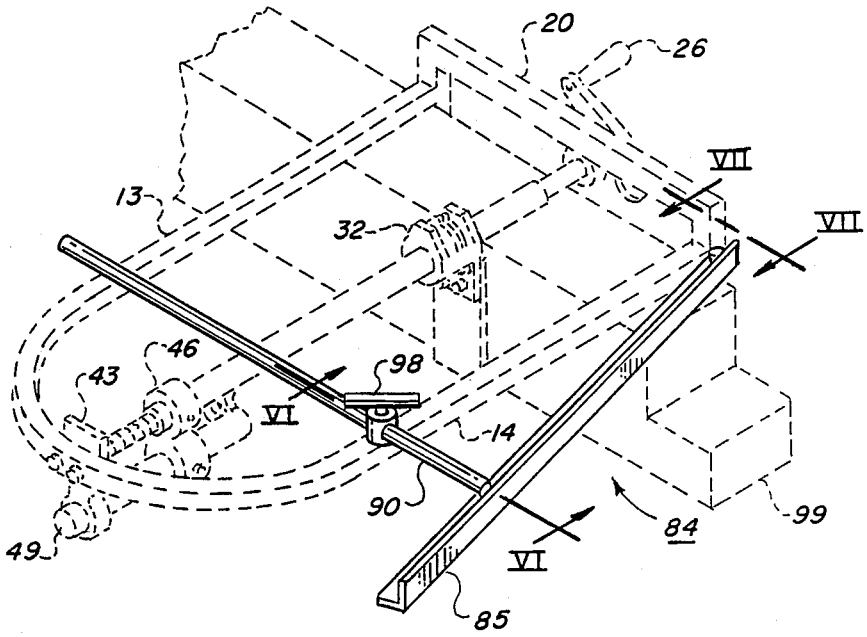
FIG. 5 is an isometric showing, partially in phantom, of a device according to FIG. 2 having a circular saw guide assembly mounted thereto in accordance therewith.

A chain saw mounting assembly 52 especially created for use in combination with the micro-adjustable clamping assembly 22 described above is shown in FIGS. 2 and 3. Each assembly 52 comprises a J-shaped bracket 53 having a rectangularly shaped body portion 54 and an outwardly extending hook portion 55. A plurality of holes 56 are drilled in spaced relationship to each other along the central longitudinal axis of body portion 54. A first and second transverse tube 57, 58 is secured as by welding to each end of J-shaped bracket 53 for receiving rod 59 alternatively therewithin for secured relationship thereto by the activation of a suitable set screw 60.

Adjacent the distal end 61 of rod 59, a base plate 62 is suitably secured, as by welding, to the periphery thereof and extends radially therefrom. An L-shaped member 63 having a base portion 64 bolted by bolt 66 to base plate 62 and a body portion 65 extending upwardly from base portion 64 in a generally normal relationship therewith. L-shaped member 63 is pivotal about the axis of bolt 66 relative to base plate 62, the importance of which will become more apparent hereafter.

A Y-shaped bracket member 68 is secured to body portion by a bolt 69 passing therethrough and secured by a nut 70 adjacent the apex 71 thereof to dispose cylindrical portion 72 of one arm 73 thereof and cylindrical portion 74 of the other arm 75 thereof in superposition to the upper edge 76 of body portion 65. An elongated saw mount plate 78 having a cylindrical portion 79 disposed at one end 80 thereof, is mounted so that cylindrical portion 79 is operatively interposed between cylinders 72, 74 in axial alignment therewith for receiving rod member 81 therethrough. Rod member 81 serves as a hinge pin and creates a pivot thereabout for a purpose which will be hereinafter explained in detail.

Mounting plate 78 is provided with a plurality of holes 82 to secure plate 78 to the bottom of a conventional chain saw 83 thereto for movement therewith.

Figure 6:
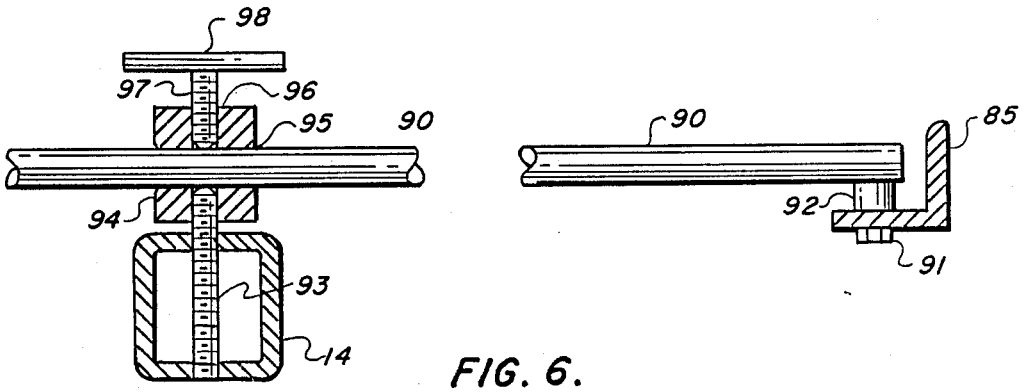
FIG. 6 is a cross-section, partially fragmented, taken along line VI—VI of FIG. 5.
Figure 7:
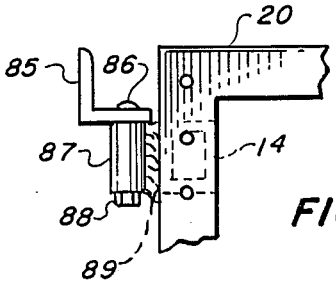
FIG. 7 is a cross-section taken along line VII—VII of FIG. 5.

An optional rotary saw guide 84, as shown in FIG. and 5, comprises an elongated arm member 85 pivotally secured by a bolt 86 passing through a collar 87 into nut 88. Collar 87 is suitably secured, as by welding, to the outer edge 89 of foot member 14 as shown in FIG. 6.

At a point on arm member 85, about two-thirds along the length thereof, a cross arm 90 is pivotally secured by means of a self tapping bolt 91 extending upwardly through arm member 85 and a spacer 92 into cross arm 90.

Cross arm 90 extends away from arm member 85 toward frame 11 and is pivotally secured thereto by threaded pin 93, and a block member 94 having passageway 95 defined transversely thereof for passing cross arm 90 therethrough. A bore 96 is drilled into block 94 from the top thereof and is disposed in communicative relationship to passageway 95 and in axial alignment with pin 93 which extends upwardly into block 94 from frame 11. A threaded lock bolt 97 is screwed into bore 96 and, by turning handle 98 bolt 97 is moved into and out of engagement with cross arm 90 to allow and restrain the sliding movement of cross arm 90 relative to block 94.

Thus, by unlocking cross arm 90 by rotating bolt 97, arm 85 can be angularly disposed relative to frame 11 by pivoting saw guide 84 simultaneously on bolt 86, bolt 91 and pin 93 to produce whatever cut is desired on the log or timber disposed securely between surface 19 of fixed foot portions 15, 16 and adjustable surface 36.

In a typical operation to size a given log or timber 99, device 10 is placed so that frame 11 sets upon timber 99 which is engaged on the proximal side thereof by surfces 19, 19 of foot portions 15, 16 and on its distal side by surface 36 of plate 35 which is brought into gross engagement with timber 99 by the manual movement of clamp 32 and finely tightened thereagainst by the use of crank 26 to rotate shaft 23 in bore 25 and threaded annular portion 46 whereupon annular portion 46, kept from rotating with shaft 23 by the restraint provided by the coaction pipe 49, with stationary bracket member 42, migrates along shaft 23 toward the crank end thereof causing tubular member 29 and clamp 32, which are integrally formed therewith, to move in the same direction whereupon timber 99 is more tightly clamped between portions 18 of frame 11 and plate 35 which depends from clamp housing 33 and hences moves with tubular member 29.

When the desired cutting action is completed, timber 99 is released from the vise-like grip of device 10 by rotating crank 26 in the opposite direction a sufficient amount to back plate 35 away from its tight engagement with timber 99 and allow either device 10 or timber 99 to be moved according to the operator's desire.

Reverting now to the situation when U-shaped frame 11 is tightly clamped to the preselected timber 99, the mounting and use of a suitable chain saw 83 therewith will now be described.

J-shaped bracket 53 is attached to foot portion 14 by passing one or more bolts (not shown) through holes 56 into foot portion 14 to provide the desired orientation of mounting assembly 52 relative to frame 11. Next, rod 59 is telescopically inserted into either tube 57 or tube 58, depending on the elevation desired to provide a preselected angular relationship between the blade of saw 83 and timber 99. Next, saw 83 is bolted to mounting plate 78 with suitable bolts and mounting plate 78 is attached to bracket 68 by interposing cylindrical portion 79 between cylinders 72, 74 so that they are in axial alignment with each other and passing rod member 81 therethrough to create a free-moving pivot thereabout to permit saw 83 to be readily moved through timber 99.

Next, if rotation of saw 83 about a horizontal axis is desired, bolt 69 is loosened, saw mount plate 78 is tilted until the desired angle is attained, and bolt 69 is retightened. If rotation of saw 83 about a vertical axis is desired, bolt 66 is loosened, L-shaped member 63 is rotated relative to base plate 62 until the desired angle is attained and bolt 66 is retightened.

From the foregoing, it is apparent that a device has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly,

What is claimed is:

1. An adjustable tool supporting device comprising a frame member; a micro-adjustment assembly mounted to said frame member and coactive therewith to clamp a timber therebetween; and a chain saw mounting assembly attached to said frame member for mounting a chain saw thereto for cutting said timber secured thereby; said chain saw mounting assembly having a J-shaped bracket secured to said frame member and having a hook portion extending outwardly therefrom; a first and second tube member secured to and disposed transversely of said J-shaped bracket member at opposite ends thereof; a first rod member insertable into one of said tube members; a base plate secured to said first rod member and extending outwardly therefrom adjacent one end thereof; an L-shaped member pivotally secured to said base plate; a Y-bracket member pivotally secured to said L-shaped member, said Y-bracket member having an upper end and a lower end and spaced axially aligned cylindrical portions adjacent said upper end; a saw mount plate having a rectangular body portion, a first end, a second end, means for securing a chain saw thereto and a cylindrical portion disposed adjacent said first end for axial alignment with said spaced axially aligned cylindrical portions of said Y-bracket member; and a second rod member axially insertable through all of said axially aligned cylindrical portions to provide a hinge pin therefor.

2. A device according to claim 1 further comprising a rotary saw guide having an elongated arm member having a first end and a second end, said arm member being pivotally secured at said first end to said frame member; adjustable locking means pivotally attached to said frame member; and a cross arm member pivotally secured to said arm member and extending outwardly therefrom through said adjustable locking means.

3. A device according to claim 1 in which said microadjustment assembly comprises: a rotatable shaft member; a tubular member circumscribing said shaft member, said tubular member having a timber engaging plate depending therefrom and coacting with said frame member to secure a timber therebetween; and means responsive to the rotation of said shaft member to adjust said timber engaging plate relative to a timber disposed between said plate and said frame.

4. A device according to claim 3 further comprising a rotary saw guide having an elongated arm member having a first end and a second end, said arm member being pivotally secured at said first end to said frame member; adjustable locking means pivotally attached to said frame member; and a cross member pivotally secured to said arm member and extending outwardly therefrom through said adjustable locking means.

5. A device according to claim 5 in which said frame member comprises: a U-shaped body member having an arc portion and first and second arm portions, said arc portion having a curvilinear central portion and a first and second end portion, said central portion extending between said first end portion and said second end portion and having a shaft-receiving bore defined therethrough intermediate said first end portion and said second end portion, said first and said second arm portions extending respectively from said first and said second end portions in spaced generally parallel relationship to each other, each of said arm portions having a distal end remote from said arc portion; a first and a second foot member respectively secured to said distal end of said first and said second arm portions, each of said foot members having an upper part and a lower part, each of said lower parts presenting a timber-engaging surface facing said arc portion; and a cross beam operatively interposed between and integrally secured to said upper part of each of said foot members.

6. A device according to claim 5 further comprising a rotary saw guide having an elongated arm member having a first end and a second end, said arm member being pivotally secured at said first end to said frame member; adjustable locking means pivotally attached to said frame member; and a cross arm member pivotally secured to said arm member and extending outwardly therefrom through said adjustable locking means.

7. A device according to claim 5 in which said microadjustment assembly comprises: a rotatable shaft member having a first end and a second end; said shaft member being operatively attached at said first end to said cross beam and at said second end in said shaft-receiving bore and rotatable therewithin; means for rotating said shaft member; a tubular member circumscribing said shaft member; a pipe clamp circumscribing said tubular member in grossly adjustable relationship thereto, said tubular member having a timber engaging plate depending therefrom coacting with said timber engaging surfaces of each of said foot members to secure a timber therebetween; and bracket means secured to said tubular member and responsive to the rotation of said shaft member to propel said timber engaging plate toward said timber engaging surfaces and more tightly grip the timber interposed therebetween.

8. A device according to claim 7 further comprising a rotary saw guide having an elongated arm member having a first end and a second end, said arm member being pivotally secured at said first end to said frame member; adjustable locking means pivotally attached to said frame member; and a cross arm member pivotally secured to said arm member and extending outwardly therefrom through said adjustable locking means.

9. An adjustable tool supporting device comprising: a U-shaped frame member having an arc portion with a shaft-receiving bore defined centrally therethrough and a body portion extending between a first end and a second end, a pair of arm members, each extending from a different one of said ends of said arc portion to a distal end, a pair of foot portions, each said foot portion being secured to said distal end of a different one of said arm members and having an upper part and a lower part, each said lower part of said foot portion presenting a timber engaging surface toward said arc portion of said frame; a cross beam operatively interposed between and integrally secured to said upper part of each of said foot portions; a micro-adjustment assembly operatively interposed between said cross beam and said shaft-receiving bore and having a timber engaging plate depending therefrom for coacting with said timber engaging surfaces to secure a timber therebetween; and a chain saw mounting assembly secured to said frame member and having adjustment means incorporated therein to tilt the blade of a chain saw mounted thereupon and selectively cut a timber operatively positioned for cutting thereby, said chain saw mounting assembly having a J-shaped bracket secured to said frame member and having a hook portion extending outwardly therefrom; a first and second tube member secured to and disposed transversely of said J-shaped bracket member at opposite ends thereof; a first rod member insertable in one of said tube members; a base plate secured to said first rod member and extending outwardly therefrom adjacent one end thereof; an L-shaped member pivotally secured to said base plate; a Y-bracket member pivotally secured to said L-shaped member, said Y-bracket member having an upper end and a lower end and spaced axially aligned cylindrical portions adjacent said upper end; a saw mount plate having a rectangular body portion, a first end and a second end, means for securing a chain saw thereto and a cylindrical portion disposed adjacent said first end for axial alignment with said spaced axially aligned cylindrical portions of said Y-bracket member; and a second rod member axially insertable through all of said axially aligned cylindrical portions to provide a hinge pin therefor.

10. A device according to claim 9 further comprising a rotary saw guide having an elongated arm member having a first end and a second end, said arm member being pivotally secured at said first end to said frame member; adjustable locking means pivotally attached to said frame member; and a cross arm member pivotally secured to said arm member and extending outwardly therefrom through said adjustable locking means.

* * * * *